US009038237B2

(12) United States Patent
Wood

(10) Patent No.: US 9,038,237 B2
(45) Date of Patent: May 26, 2015

(54) SQUEEGEE ASSEMBLY

(75) Inventor: David W. Wood, Maple Plain, MN (US)

(73) Assignee: Nilfisk-Advance, Inc., Plymouth, MN (US)

( * ) Notice: Subject to any disclaimer, the term of this patent is extended or adjusted under 35 U.S.C. 154(b) by 879 days.

(21) Appl. No.: 12/531,660

(22) PCT Filed: Mar. 18, 2009

(86) PCT No.: PCT/US2009/037545

§ 371 (c)(1), (2), (4) Date: Sep. 16, 2009

(87) PCT Pub. No.: WO2010/107432

PCT Pub. Date: Sep. 23, 2010

(65) Prior Publication Data

US 2011/0314632 A1 Dec. 29, 2011

(51) Int. Cl.

| | |
|---|---|
| ***A47L 9/00*** | (2006.01) |
| ***A47L 11/30*** | (2006.01) |
| ***A47L 11/40*** | (2006.01) |

(52) U.S. Cl.

CPC ..... *A47L 11/30* (2013.01); *A47L 11/4044* (2013.01)

(58) Field of Classification Search

CPC .... A47L 11/4044; A47L 11/30; A47L 7/0009
USPC ..... 15/375, 401
See application file for complete search history.

(56) References Cited

U.S. PATENT DOCUMENTS

| | | | | | |
|---|---|---|---|---|---|
| 2,822,061 | A | * | 2/1958 | Pettit et al. | 55/434 |
| 3,107,387 | A | * | 10/1963 | Katt | 15/375 |
| 3,118,165 | A | * | 1/1964 | Meyerhoefer | 15/402 |
| 5,067,199 | A | | 11/1991 | Alazet | |
| 5,212,848 | A | * | 5/1993 | Geyer | 15/401 |
| 5,280,666 | A | * | 1/1994 | Wood et al. | 15/401 |
| 5,797,161 | A | * | 8/1998 | Campbell | 15/322 |
| 5,911,260 | A | | 6/1999 | Suzuki | |
| 5,933,911 | A | | 8/1999 | Windmeisser | |
| 6,047,437 | A | * | 4/2000 | Suzuki | 15/401 |

(Continued)

FOREIGN PATENT DOCUMENTS

| | | | |
|---|---|---|---|
| CN | 200984139 | Y | 12/2007 |
| JP | 638848 | A | 5/1994 |

(Continued)

OTHER PUBLICATIONS

"Japanese Application Serial No. 2012-500770, Office Action mailed Jan. 24, 2013", 4 pgs.

(Continued)

*Primary Examiner* — Bryan R Muller

(74) *Attorney, Agent, or Firm* — Schwegman Lundberg & Woessner, P.A.

(57) ABSTRACT

A squeegee assembly for wiping a surface comprises a front flexible blade having an outer surface, an inner surface and a floor engaging edge, a rear flexible blade having an outer surface, an inner surface and a wiping edge, a support upon which the front and rear flexible blades are mounted, a vacuumized chamber bounded by the front blade, rear blade, support, and the surface, and a suction tube coupled to the support and positioned between the front and rear flexible blades. The rear flexible blade includes at least one aperture extending between the outer surface and the inner surface and spaced from the wiping edge.

16 Claims, 17 Drawing Sheets

(56) References Cited

U.S. PATENT DOCUMENTS

| | | | | |
|---|---|---|---|---|
| 6,108,859 | A * | 8/2000 | Burgoon | 15/320 |
| 6,773,387 | B2 | 8/2004 | Harnish | |
| 7,254,867 | B2 * | 8/2007 | Legatt et al. | 15/401 |
| 2005/0115015 | A1 | 6/2005 | Legatt et al. | |

FOREIGN PATENT DOCUMENTS

| | | | |
|---|---|---|---|
| JP | 2002238820 | A | 8/2002 |
| JP | 2007089725 | A | 4/2007 |
| JP | 2009521284 | A | 6/2009 |
| JP | 2012520727 | A | 9/2012 |
| WO | WO-2007076181 | A2 | 7/2007 |
| WO | WO-2010107432 | A1 | 9/2010 |

OTHER PUBLICATIONS

"European Application Serial No. 09842004.5, Extended Search Report mailed Jan. 10, 2013", 5 pgs.
"International Application Serial No. PCT/US2009/037545, Written Opinion mailed May 18, 2009", 5 pgs.
"International Application Serial No. PCT/US2009/0937545, International Search Report mailed May 18, 2009", 1 pgs.
Chinese Application Serial No. 200980159389.1, Office Action mailed Jan. 20, 2014, 30 pgs.
Chinese Application Serial No. 200980159389.1, Office Action mailed Jun. 8, 2013, 27 pgs.
Chinese Application Serial No. 200980159389.1, Response filed Oct. 14, 2013 to Office Action mailed Jun. 8, 2013, 15 pgs.

* cited by examiner

SQUEEGEE ASSEMBLY

BACKGROUND OF THE INVENTION

The present invention relates generally to a cleaning apparatus. More specifically, the present invention relates to a vacuumized squeegee assembly structured for attachment to a floor cleaning system and having improved pickup capabilities.

The use of vacuumized squeegee assemblies for wiping a surface and collecting dirty solution is conventional in many applications including, but not limited to, floor surface cleaning machines such as floor scrubbers. Typically, the front and rear blades of the squeegee assembly are always in contact with the floor surface so that any liquid on the floor surface is exposed to, picked up, and carried by airflow in the squeegee assembly. The rear blade in particular is provided with sufficient downward force to bend the blade outward so that only one edge of the blade engages the floor surface. Exemplary squeegee assemblies incorporating front and rear blades are disclosed in U.S. Pat. Nos. 7,254,867 and 6,557,207.

The surface qualities of the floor are an important factor in the ability of the squeegee assembly to function as desired. As appreciated by those skilled in the art, squeegee assemblies function ideally with a level, smooth floor surface. However, floor surfaces are of a variety of types which are not always level and/or completely smooth such as by design as in the case of grouted tile or textured floors, by necessity or damage such as in the case of seams and/or cracks, or by wear such as rough or pitted surfaces. In those instances, moisture may be located in depressions which may be easily passed over by the blades and/or not exposed to airflow sufficient to be picked up thereby.

FIG. 1 is a diagram illustrating one embodiment of a conventional squeegee assembly. In particular, FIG. 1 illustrates a cross-section of conventional squeegee assembly 10, which generally includes support 12, suction tube 14 structured for connection to a vacuum source, front flexible blade 16, and rear flexible blade 18. Front and rear flexible blades 16 and 18 are spaced apart and attached to an inside surface of support 12 at respective front and rear portions thereof. As illustrated in FIG. 1, front and rear flexible blades 16 and 18 of squeegee assembly 10 are in contact with a floor surface F comprising a plurality of tiles T separated by grout lines G.

During operation of conventional squeegee assembly 10, when front and rear flexible blades 16 and 18 pass over grout line G, air may be taken through the grout line. Such air passing between the rear wiping blade and the grout line channel may assist in removing water from the grout lines or cracks by entraining liquid in the grout line in the rapidly moving air.

However, in some conventional squeegee assemblies, dirty liquid may pool against a portion of the rear flexible blade adjacent the suction tube due to the flow dynamics within the suction chamber formed between the front and rear flexible blades. This phenomenon is illustrated in FIG. 2A, which is a bottom view of squeegee assembly 10 showing a pool of liquid P built-up against rear flexible blade 18 adjacent suction tube 14. In particular, the majority of the liquid is suctioned through suction tube 14 as indicated by the broken lines between front and rear flexible blades 16 and 18 that are directed toward the suction tube. However, a portion of the liquid is not suctioned through suction tube 14, and instead builds-up and forms the pool of liquid P near the center of rear flexible blade 18. Thereafter, when rear flexible blade 18 passes over a grout line, crack, or other irregularity in the floor, a gap is formed between rear flexible blade 18 and the floor surface allowing the pooled dirty liquid P to pass through the gap and splash in a rearward direction leaving behind a puddle on the floor. Such puddles are not only aesthetically displeasing, but they also create safety hazards for individuals who must walk across the floor after the floor has been cleaned.

More particularly, liquid is directed by the curvature of the blades and by the air moving in the direction of the suction tube toward the rearmost portion of the squeegee assembly where it is carried up into a recovery tank. Both air and entrained liquid move along the rear blade and into the suction tube opening during operation of the squeegee assembly. However, as illustrated in FIG. 2B, there is a region of very low air flow near suction tube 14 where the air stream L from the left side of suction tube 14 comes together with the air stream R from the right side of suction tube 14. A significant amount of liquid may be collected in this region, thus creating the pool of liquid P. Consequently, and as depicted in the diagram of rear blade 18 in FIG. 2C, when the rearmost portion of rear blade 18 approaches grout line G (or other surface irregularity), this pool of liquid P will spread into the grout line. After the squeegee assembly passes over grout line G, this liquid may be expelled from grout line G due in part to the action of rear blade 18 slapping the water out as it passes over the grout line.

Several attempts have been made to address the above shortcomings. One attempt has been to increase the strength of the vacuum pump coupled to the suction tube. However, this solution has proved costly and is not ideal due to the increased power demands. Moreover, increasing the strength of the vacuum pump does not eliminate the area of low air flow near the vacuum port. A second attempt has been to increase the suctioning force of dirty liquid by reducing the space between the front and rear flexible blades. However, this solution has not been successful because reducing the space between the front and rear flexible blades limits the width of the suction port, which in turn necessitates an extreme transition from a narrow slotted vacuum port to a round vacuum hose. Such an severe transition adds height to the squeegee assembly and may become easily clogged with debris. As a result, it is almost impossible to suction all of the dirty liquid from grout lines and cracks effectively with a conventional vacuumized squeegee.

Thus, there is a need for a squeegee assembly having improved pickup capabilities. There is a further need for a squeegee assembly that is designed to minimize the pooling of liquid against the rear blade of the assembly.

SUMMARY OF THE INVENTION

The present invention addresses at least some of the above-referenced issues by providing a squeegee assembly for wiping a surface that includes a front flexible blade having an outer surface, an inner surface and a floor engaging edge, a rear flexible blade having an outer surface, an inner surface and a wiping edge, a support upon which the front and rear flexible blades are mounted, a vacuumized chamber bounded by the front blade, rear blade, support, and the surface, and a suction tube coupled to the support and positioned between the front and rear flexible blades. The rear flexible blade includes at least one aperture extending between the outer surface and the inner surface and spaced from the wiping edge.

Thus, the present invention provides a novel squeegee assembly with improved pickup on rough surfaces, grouted tile or textured surfaces, pitted surfaces, or over seams and cracks in a surface.

The present invention also provides a novel squeegee assembly having improved airflow into the suction tube.

Further, the present invention provides a novel squeegee assembly having airflow through the rear blade to minimize or prevent pooling of liquid within the squeegee assembly.

DETAILED DESCRIPTION OF THE INVENTION

Figure 3:
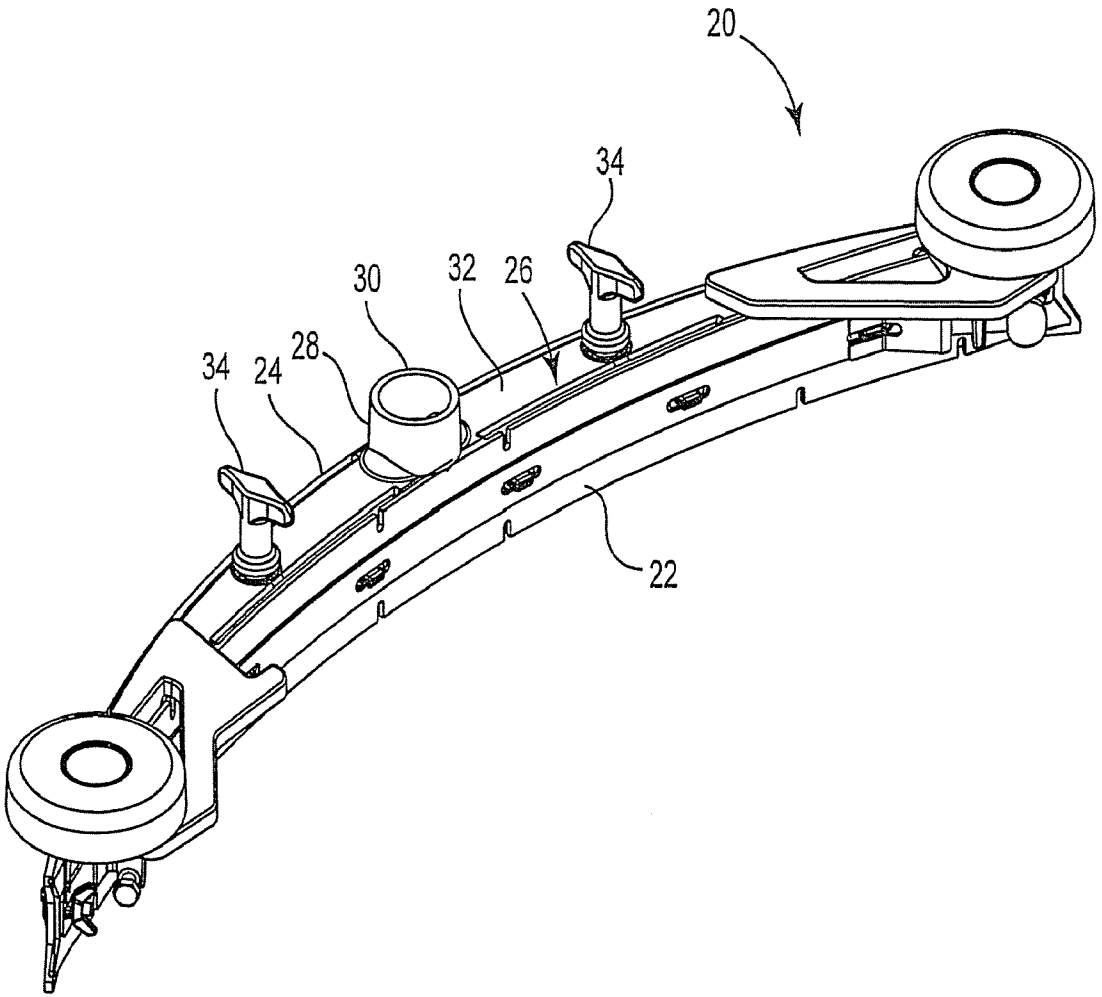
FIG. 3 is a perspective view of one exemplary embodiment of a squeegee assembly in accordance with the present invention.

Generally speaking, the present invention involves an improved squeegee assembly for wiping a surface and collecting a liquid through vacuum pickup. FIG. 3 is a perspective view of one such exemplary squeegee assembly 20 in accordance with the present invention. As illustrated in FIG. 3, squeegee assembly 20 generally includes front flexible blade 22, rear flexible blade 24, support 26, and suction tube 28 structured for connection to a vacuum source. Front and rear flexible blades 22 and 24 extend from a bottom side of support 26, and are structured and designed to contact a floor surface. An upper end 30 of suction tube 28 extends from a top side 32 of support 26. Also extending from top side 32 of support 26 are connection means 34 for connecting squeegee assembly 20 to a surface cleaning machine. Any suitable connection means may be used without departing from the intended scope of the present invention.

As will be appreciated by those skilled in the art, squeegee assembly 20 may be utilized with any surface cleaning machine that incorporates the use of a vacuumized squeegee assembly for retrieving a liquid applied to a surface. Exemplary, but non-limiting floor surface cleaning machines that may utilize a squeegee assembly in accordance with the present invention are disclosed in U.S. Pat. Nos. 6,397,429 and 6,519,808, which are incorporated by reference herein in their entireties.

In operation, squeegee assembly 20 may be coupled to a surface cleaning machine such that front blade 22 is oriented with respect to the forward movement of the surface cleaning machine. As illustrated in FIG. 3, front and rear flexible blades 22 and 24 are designed such that they are curved when attached to support 26. Thus, solution tends to pass through openings or slots in front blade 22 or underneath front blade 22 and is not directed to travel past the ends of the squeegee assembly. However, as will be appreciated by those skilled in the art, front and rear flexible blades 22 and 24 of squeegee assembly 20 are illustrated in FIG. 3 as having a curved design merely for purposes of example and not limitation. Thus, it should be appreciated that the teachings of the present invention may have application to other types of squeegee designs, including but not limited to a straight-blade design.

Figure 4:
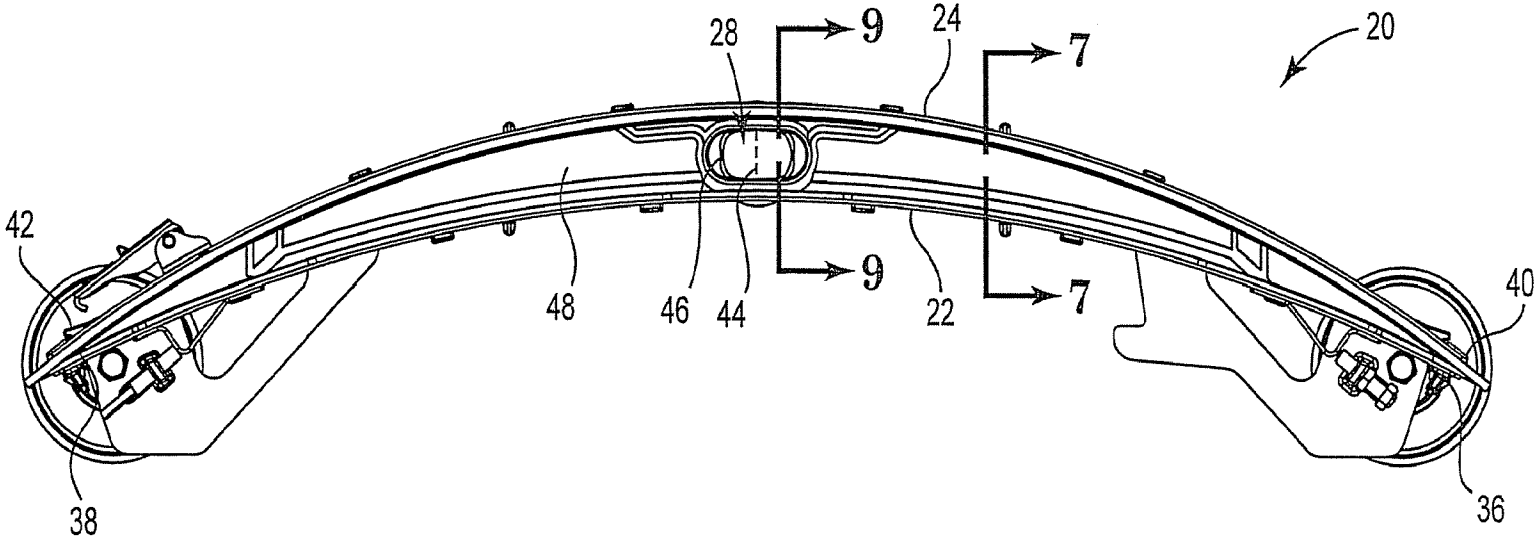
FIG. 4 is a bottom view of the squeegee assembly of FIG. 3.

FIG. 4 is a bottom view of squeegee assembly 20. As illustrated in FIG. 4, front blade 22 includes first end 36 and second end 38, while rear blade 24 includes first end 40 and second end 42. Front and rear flexible blades 22 and 24 are mounted to support 26 such that blades 22 and 24 are spaced by a maximum distance near the center 44 of suction tube 28 and taper towards each other so that first ends 36 and 40 and second ends 38 and 42 are closely adjacent and/or tight against each other in the assembled position illustrated in FIG. 4.

As further illustrated in FIG. 4, a lower end 46 of suction tube 28 extends through bottom side 48 of support 26 such that suction tube 28 is substantially aligned with the center of support 26. Thus, suction tube 28 may be in fluid communication with a suction chamber formed between front blade 22, rear blade 24, bottom side 48 of support 26, and the surface upon which front and rear blades 22 and 24 are in contact.

As will be appreciated by those skilled in the art, during operation of the surface cleaning machine a vacuum may be supplied through suction tube 28 such that air and solution may be pulled into squeegee assembly 20 through one or more slots in front blade 22, or alternatively pulled from underneath front blade 22. Suction tube 28 may further be in fluid communication with a recovery tank, which in turn may be in fluid communication with a vacuum assembly operable to draw air from the hollow interior of the recovery tank. Rear blade 24 may be structured to function as a "wiper" to leave the floor surface substantially dry after liquid has been suctioned therefrom.

Front and rear flexible blades 22 and 24 may be formed from any suitable material as will be appreciated by those skilled in the art. Exemplary blade materials include, but are not limited to, gum rubber, neoprene, urethane, and the like.

Figure 5:
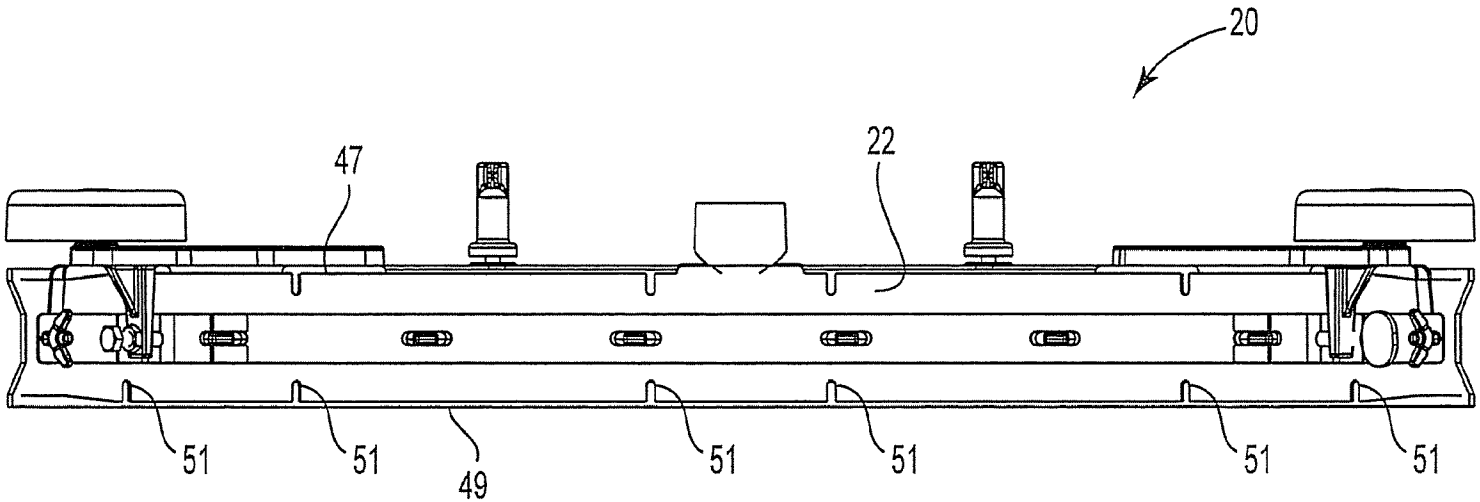
FIG. 5 is a front view of the squeegee assembly of FIG. 3.

FIG. 5 is a front view of squeegee assembly 20 in accordance with the present invention. As illustrated in FIG. 5, front blade 22 includes upper elongated surface 47, lower elongated surface 49, and a plurality of notches or slots 51 adjacent lower surface 49 and spaced along the length of the blade in order to allow liquid to pass therethrough. In particular, front blade 22 is depicted as including six slots 51 spaced apart such that three slots are positioned to the left of center 44 of suction tube 28 (as shown in FIG. 4) and three slots are positioned to the right of center 44 of suction tube 28, wherein the position of the slots on the right "mirrors" the position of the slots on the left. Although the position of the slots on the right of suction tube 28 mirrors the position of the slots on the left of suction tube 28 in the illustrated embodiment, those skilled in the art will appreciate that other slot positions are also possible. For instance, the position of one or more of the slots on one side of suction tube 28 may be offset from the position of the corresponding slot on the other side of suction tube 28. Additionally, as will be appreciated by those skilled in the art, the shape, number, and spacing of slots 51 may vary from that shown in FIG. 5. Thus, the slot configuration of FIG. 5 is illustrated merely for purposes of example and not limitation.

Figure 1:
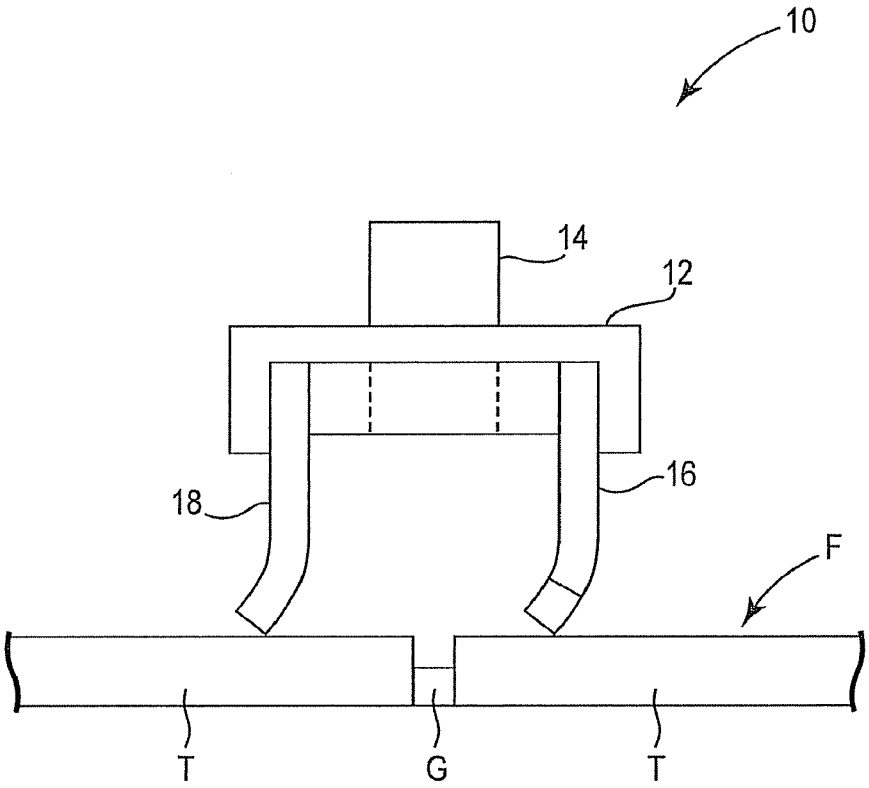
Fig. 1 PRIOR ART
FIG. 1 is a diagram illustrating one embodiment of a conventional squeegee assembly.
Figure 2A:
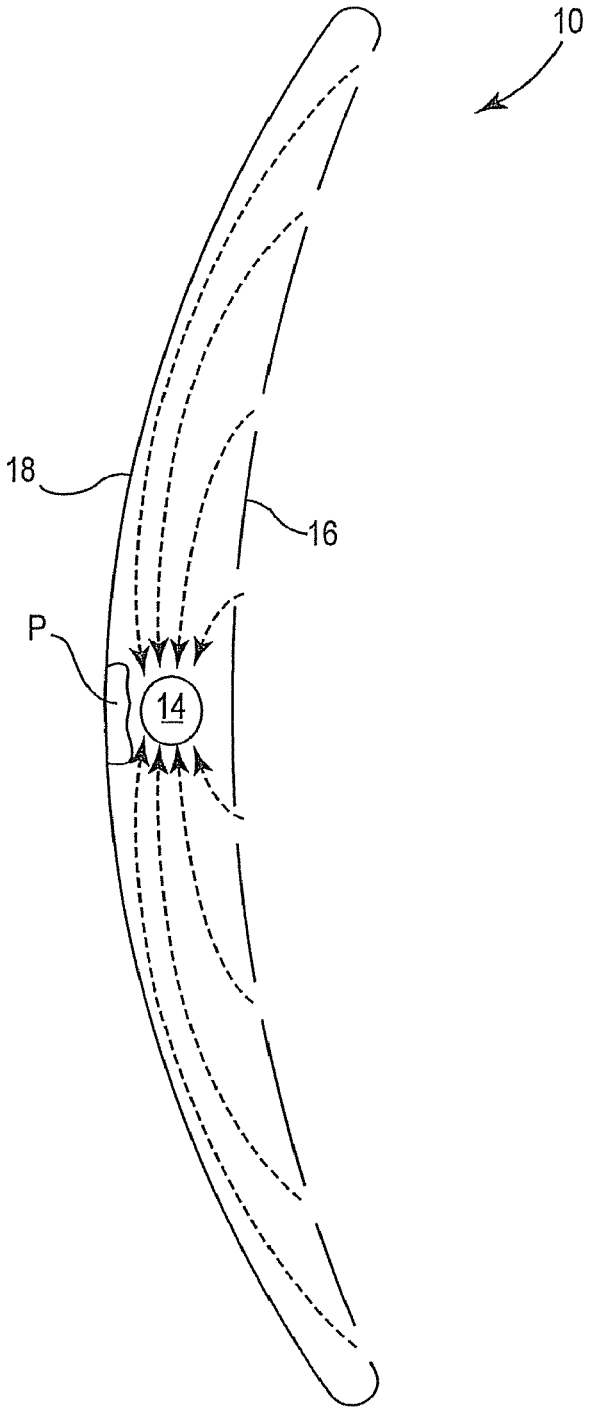
Fig. 2A PRIOR ART
FIGS. 2A-2C illustrate various diagrams of the conventional squeegee assembly of FIG. 1 showing a pool of liquid built-up against a rear flexible blade of the squeegee assembly.
Figure 2B:
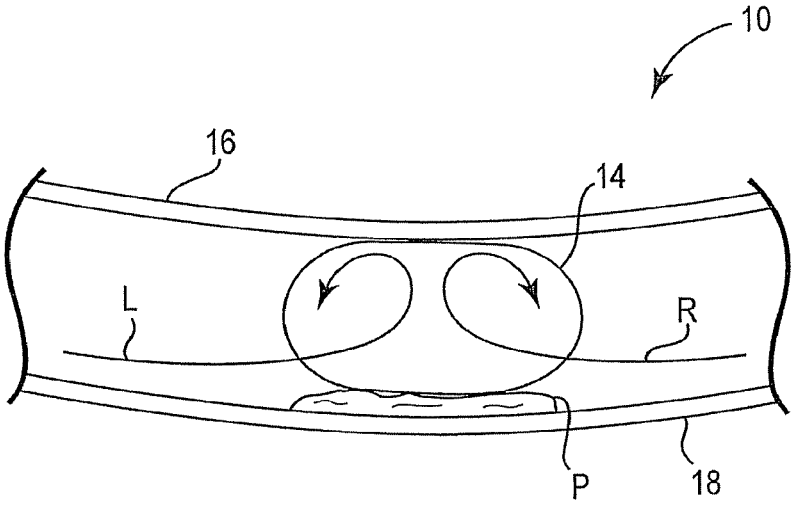
Fig. 2B PRIOR ART
Figure 2C:
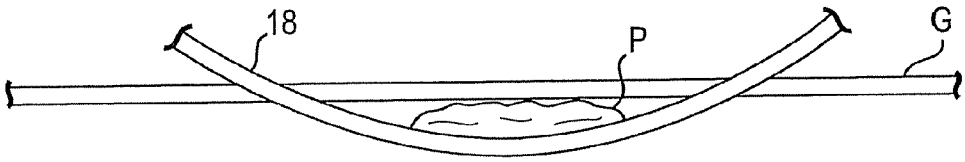
Fig. 2C PRIOR ART
Figure 6:
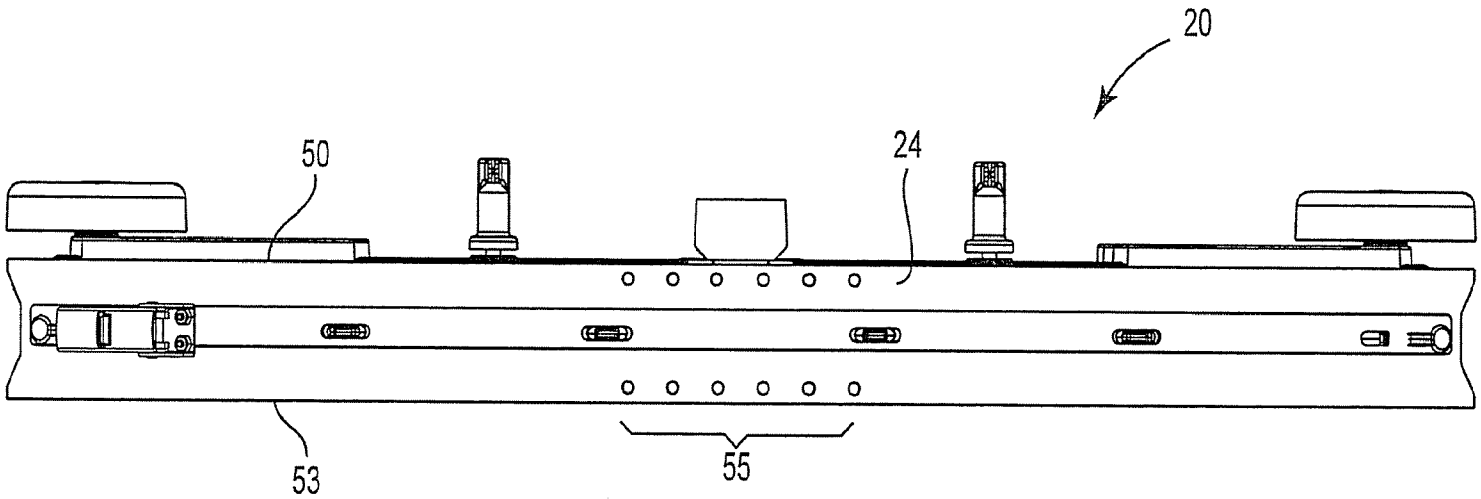
FIG. 6 is a rear view of the squeegee assembly of FIG. 3.

FIG. 6 is a rear view of squeegee assembly 20 in accordance with the present invention. As illustrated in FIG. 6, rear blade 24 includes upper elongated surface 50, lower elongated surface 53, and a plurality of vent holes or apertures 55 adjacent lower surface 53 and spaced along a portion of the length of the blade. As will be discussed in further detail to follow, apertures 55 allow air from outside squeegee assembly 20 to be suctioned into the chamber formed between squeegee assembly 20 and the surface being cleaned in order to minimize or prevent the build-up of liquid adjacent an inner surface of rear blade 24, as previously discussed with respect to FIG. 2.

As will be appreciated by those skilled in the art, apertures 55 are structured to change the flow dynamics within the suction chamber during operation. As a result, when rear flexible blade 24 passes over a grout line, crack, or other irregularity in the floor, thus creating a gap between lower surface 53 of the blade and the floor surface, the amount of liquid that would otherwise splash in a rearward direction from within the suction chamber is greatly reduced or eliminated. As a result, not only are the aesthetically displeasing puddles experienced by prior art designs prevented, but the potential safety hazards stemming from such puddles are also minimized.

Figure 7:
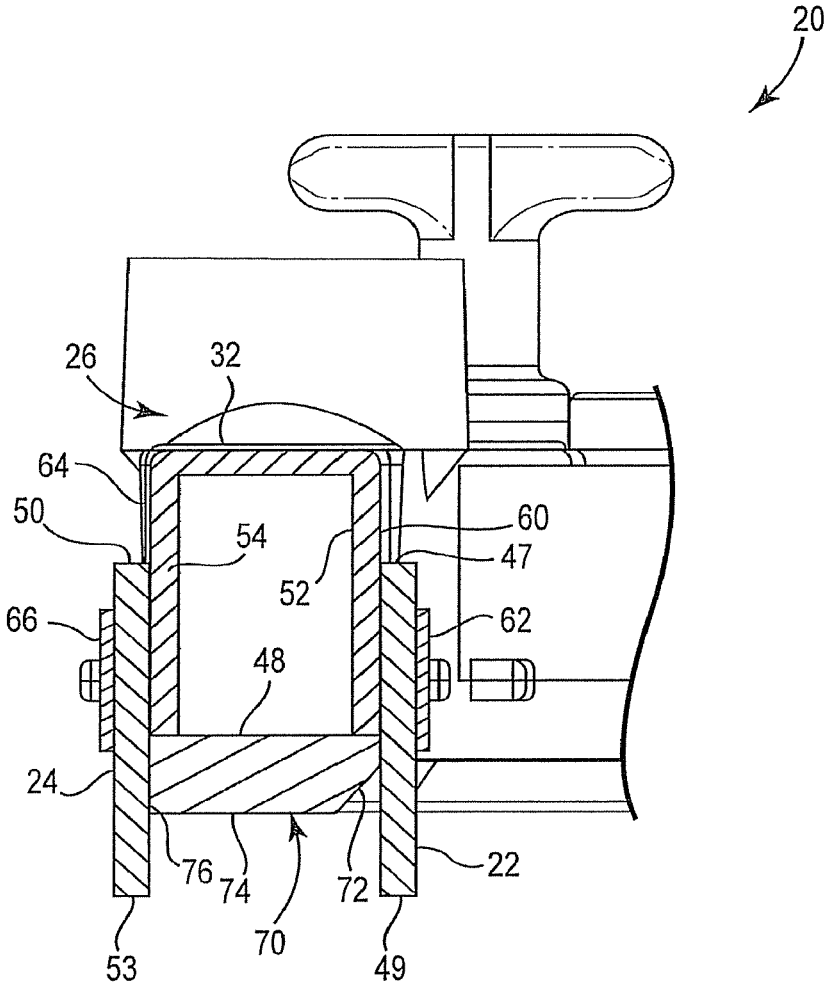
FIG. 7 is a cross-sectional view of the squeegee assembly taken along line 7-7 of FIG. 4.

FIG. 7 is a cross-sectional view of squeegee assembly 20 taken along line 7-7 of FIG. 4. As illustrated in FIG. 7, in addition to top side 32 and bottom side 48, support 26 further includes front side 52 and rear side 54. As will be appreciated by those skilled in the art, top side 32 may be structured such that it may be removably secured to a mount of suitable provisions for operatively engaging squeegee assembly 20 on the floor surface during an operation mode as well as for raising squeegee assembly 20 from the floor surface during a transport or storage mode. Top side 32 of support 26 may be coupled to the mount with, for example, connecting means 34 illustrated in FIG. 3. In one exemplary embodiment, top side 32 of support 26 may be a flat plate fabricated from stock material such as sheet or plate steel. However, numerous other constructions are contemplated and within the intended scope of the present invention such as casting, injection molding, forging, etc.

As illustrated in FIG. 7, front and rear sides 52 and 54 extend generally perpendicular to the surface to be wiped. In the exemplary embodiment of squeegee assembly 20 illustrated herein, front and rear sides 52 and 54 may be curved between their ends parallel to the surface to be wiped. Because first and second blades 22 and 24 are flexible, the blades take on the curvature of the corresponding side of support 26 to which they are attached. As previously illustrated in FIG. 4, the curvature of front side 52 may be larger than the curvature of rear side 54. Thus, when the ends of front and rear sides 52 and 54 are positioned tight against each other, front and rear sides 52 and 54 are spaced by a maximum distance at the center and then taper towards each other from the center in a manner similar to that previously discussed with respect to front and rear blades 22 and 24.

When assembled, front blade 22 is structured to abut with outer surface 60 of front side 52 of support 26 and may be removably secured thereto via any suitable fastening means. In one exemplary fastening means, a clamping band 62 may be used to clamp front blade 22 against front side 52 of support 26 such that front blade 22 is "sandwiched" therebetween. Similarly, rear blade 24 is structured to abut with outer surface 64 of rear side 54 of support 26 and is removably secured thereto via any suitable fastening means, such as with a clamping band 66 that is similar to clamping band 62 previously described.

In the embodiment of squeegee assembly 20 illustrated in FIG. 7, front blade 22 has a thickness that is less than a thickness of rear blade 24. For example, the thickness of front blade 22 may be about 0.13 inches, while the thickness of rear blade 24 may be about 0.19 inches for a squeegee assembly having a path width of about 28 inches or less. For a path width of between about 28 inches and about 34 inches, a front blade may have a thickness of about 0.19 inches and a rear blade may have a thickness of about 0.25 inches. For path widths greater than about 34 inches, a front blade may have a thickness of about 0.25 inches and a rear blade may have a thickness of about 0.38 inches. However, numerous other thicknesses are contemplated and may depend upon the type of blade material used, the suction power of the machine on which the squeegee assembly is used, the downward force on the blades, and other factors which may known to one skilled in the art. In one alternative embodiment, front and rear blades 22 and 24 may instead have thicknesses that are substantially equal to one another. In another alternative embodiment, one of the front or rear blades may have a lower extent that is elevated above the lower extent of the other blade when the blades are in an unflexed and vertical position.

As will be appreciated by those skilled in the art, front blade 22 may be reversible so that both the upper and lower elongated surfaces 47 and 49 of the blade may be oriented and utilized as the lower wiping edge. Additional slots 51 may be formed adjacent upper edge 47 to allow liquid to pass therethrough as previously described when the blade is reversed. Similarly, rear blade 24 may be reversible so that both the upper and lower elongated surfaces 50 and 53 may be oriented and utilized as the lower wiping edge. Additional apertures 55 may be formed adjacent upper edge 50 to allow air from outside squeegee assembly 20 to be suctioned into the chamber formed between squeegee assembly 20 and the surface being cleaned when the blade is reversed.

Bottom side 48 of support 26 extends between front side 52 and rear side 54 and is in a spaced generally parallel relation to top side 32. Furthermore, as illustrated in FIG. 7, support 26 may be hollow in order to reduce the weight of squeegee assembly 20 and make it easier to install and remove the assembly. In one exemplary method of manufacturing, top side 32, bottom side 48, front side 52, and rear side 54 of support 26 may be formed from separate plates that are interconnected together via any suitable connection means, such as by welding or with an adhesive. This configuration allows support 26 to be fabricated from stock material such as sheet or plate steel. However, in other embodiments, support 26 may be formed from a solid or hollow beam that is bent into the desired shape. In yet other embodiments, support 26 may be formed by a forging or casting process. Numerous other fabrication methods exist as will be appreciated by those skilled in the art.

As further illustrated in FIG. 7, bottom side 48 of support 26 may also include support extension 70 extending therefrom. In the embodiment of squeegee assembly 20 illustrated in FIG. 7, extension 70 is shown formed integrally with bottom side 48 of support 26. Alternatively, extension 70 may be formed separately from bottom side 48 of support 26 and coupled thereto to form a single component via any suitable connection means, such as with a fastener.

Support extension 70 generally includes leading surface 72, lower surface 74, and trailing surface 76. As illustrated in FIG. 7, leading surface 72 extends generally linearly from front side 52 of support 26 at a rearward angle to lower surface 74. The angle formed between leading surface 72 and a plane parallel with lower surface 74 may be on the order of about 50 degrees, although numerous other angles are contemplated and within the intended scope of the present invention. Additionally, trailing surface 76 may extend generally perpendicularly to lower surface 74. However, trailing surface 76 may alternatively be disposed at some other angle relative to lower surface 74.

It should be appreciated that leading surface 72 is structured to create a space behind front blade 22 in its unflexed or relaxed state during transport or storage of squeegee assembly 20. As will be discussed in further detail to follow, front blade 22 may be designed to bend or flex into this space in an operational mode where squeegee assembly 20 is being utilized to remove liquid from a surface during a cleaning procedure.

Although support 26 is illustrated in FIG. 7 with this support extension 70, those skilled in the art will appreciate that the features of support extension 70 are presented merely for purposes of example and are not necessary components of the present invention. Thus, support 26 may alternatively include, for example, a substantially flat bottom side 48 without a contoured support extension without departing from the intended scope of the present invention.

Figure 8:
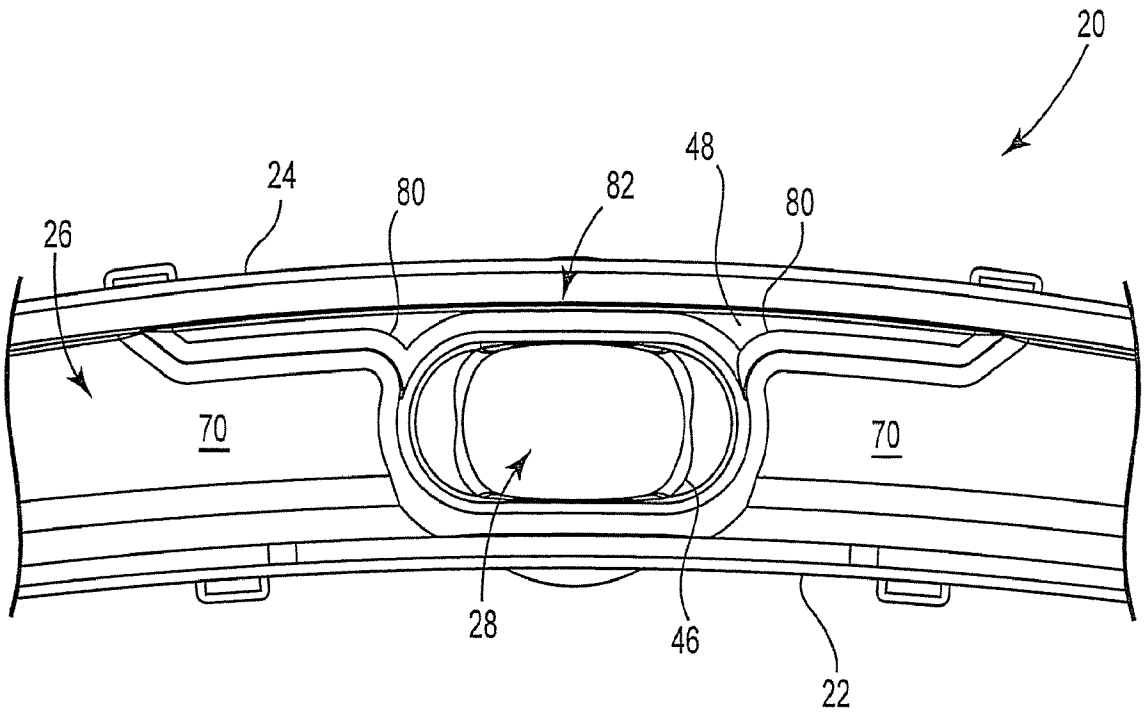
FIG. 8 is an enlarged bottom view of a center portion of the squeegee assembly of FIG. 3 illustrating a flow directing feature.

FIG. 8 is an enlarged bottom view of a portion of squeegee assembly 20 near suction tube 28. As illustrated in FIG. 8, support extension 70 may include one or more contoured flow directors 80 adjacent suction tube 28. Particularly, each flow director 80 may be in the form of a contoured shoulder portion, and may, along with bottom side 48 of support 26, define an inflow channel 82 to help guide liquid to flow from the suction chamber between front and rear blades 22 and 24 and into lower end 46 of suction tube 28.

Figure 9:
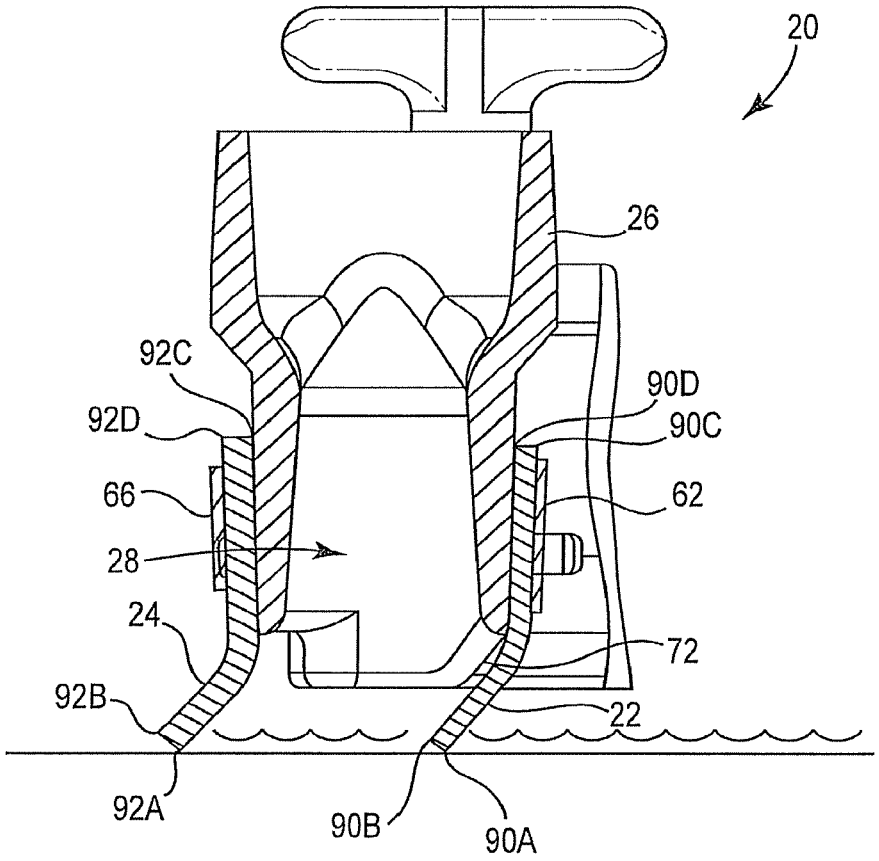
FIG. 9 is a diagram of the exemplary squeegee assembly of FIG. 3 in an operational mode wherein liquid deposited on a surface during a cleaning procedure is removed.

Now that the basic construction of squeegee assembly 20 according to one exemplary embodiment of the present invention has been set forth, the operation of squeegee assembly 20 will be highlighted. In particular, FIG. 9 is a cross-sectional view of squeegee assembly 20 taken along line 9-9 of FIG. 4 illustrating the squeegee assembly in an operational mode wherein liquid deposited on a surface during a cleaning procedure is removed. During the operational mode when the floor cleaning machine and attached squeegee assembly 20 are being moved in a forward direction with front blade 22 ahead of rear blade 24, front and rear blades 22 and 24 flex at an obtuse angle generally at the level of the bottom side of support 26. When leading surface 72 is angled and linear as illustrated in FIG. 9, front blade 22 may flex such that it is closely adjacent to leading surface 72 in the operational mode in order to minimize airflow between leading surface 72 and front blade 22.

More particularly, during operation of a surface cleaning machine including squeegee assembly 20, a solution is first generally applied to the surface and worked on the floor surface such as by scrubbing brushes. As the cleaning machine is moved in a forward direction, front blade 22 passes over the surface which had been previously worked, with front blade 22 allowing solution to enter squeegee assembly 20 through slots 51 such that it is contained between front and rear blades 22 and 24. Air is drawn from between and along front and rear blades 22 and 24, through suction tube 28 and into the reservoir. Furthermore, in accordance with the present invention, air is also drawn from outside of squeegee assembly 20 through apertures 55 in rear blade 24 and into suction tube 28. Thus, liquid that would otherwise pool against rear blade 24 as illustrated above in reference to FIG. 2 is entrained by the flow of air through apertures 55 in rear blade 24 and suctioned through suction tube 28 with the rest of the liquid disposed between front and rear blades 22 and 24.

As should be appreciated based on the foregoing disclosure, the presence of apertures 55 improves the flow dynamics within squeegee assembly 20 during operation in order to avoid or minimize the pooling of liquid against rear blade 24. Consequently, when rear blade 24 passes over a grout line, crack, or other irregularity in the floor, thus creating a gap between lower surface 53 of the blade and the floor surface, the amount of liquid that would otherwise splash in a rearward direction from within the suction chamber is greatly reduced or eliminated. The result is a cleaning procedure yielding improved results from both an aesthetic and safety standpoint.

As mentioned above, both front blade 22 and rear blade 24 may be reversible such that both of their upper and lower elongated edges may be used as the lower wiping edge. In particular, and as illustrated in FIG. 9, front blade 22 includes first wiping edge 90A, second wiping edge 90B, third wiping edge 90C, and fourth wiping edge 90D. Therefore, each front blade 22 may be used in four different configurations prior to disposing of the blade. Similarly, rear blade 24 includes first wiping edge 92A, second wiping edge 92B, third wiping edge 92C, and fourth wiping edge 92D. It follows that each rear blade 24 may be used in four different configurations as well prior to disposing of the blade.

Figure 10:
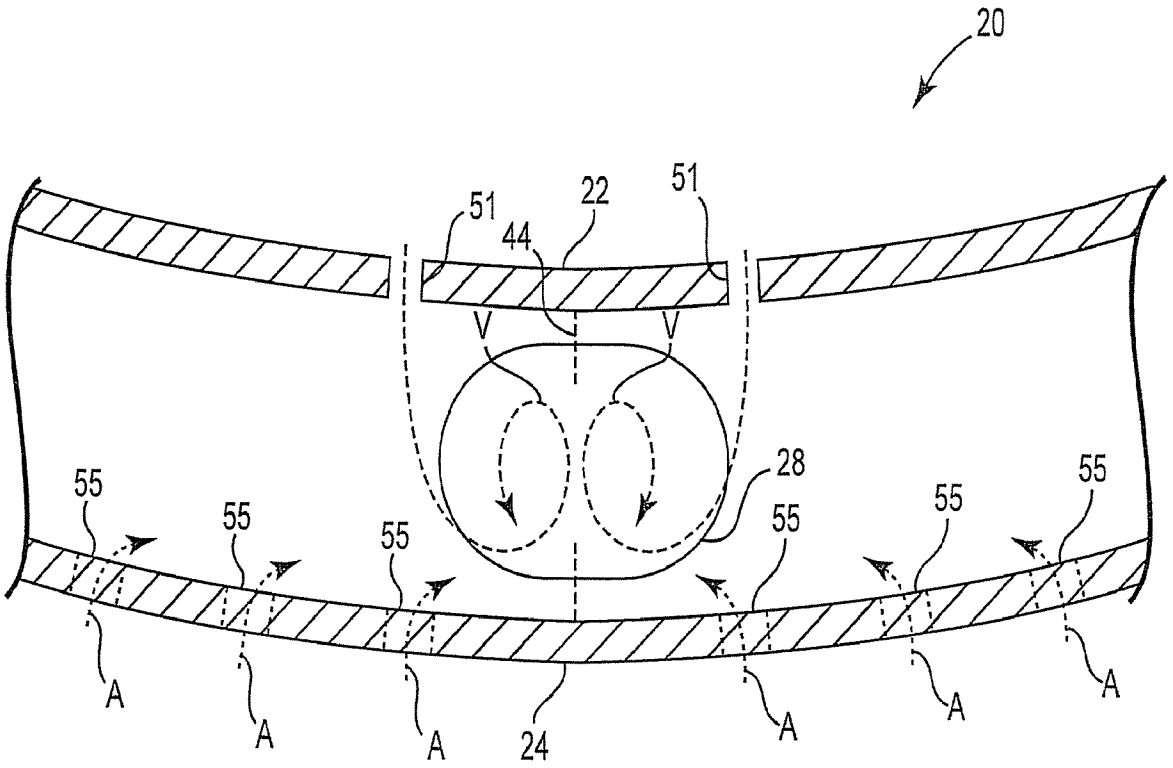
FIG. 10 is a diagram illustrating the exemplary airflow within the squeegee assembly of FIG. 3.

An exemplary diagram illustrating the airflow within squeegee assembly 20 is presented in FIG. 10. As illustrated in FIG. 10, air A is drawn in through apertures 55 in rear blade 24 and is suctioned toward suction tube 28. The presence of apertures 55 creates an additional source of airflow between front and rear blades 22 and 24. As will be appreciated by those skilled in the art, this airflow may be focused along the middle portion of rear blade 24 near suction tube 28 where pooling of liquid may otherwise occur. Particularly, by creating airflow along the inner surface of rear blade 24 during operation of the surface cleaning machine, liquid entrained in the air flow and suctioned through suction tube 28 before they are able to pool along rear blade 24.

Additionally, when slots 51 are equally spaced such that the position of the slots 51 to the left of center 44 of suction tube 28 mirrors the position of the slots 51 to the right of suction tube 28 as previously discussed with reference to FIG. 5, a pair of vortexes V may be formed within suction tube 28. Providing equally spaced apart apertures 55 in rear blade 24 may help to maintain the pair of vortexes V as will be appreciated by those skilled in the art.

Figure 11:
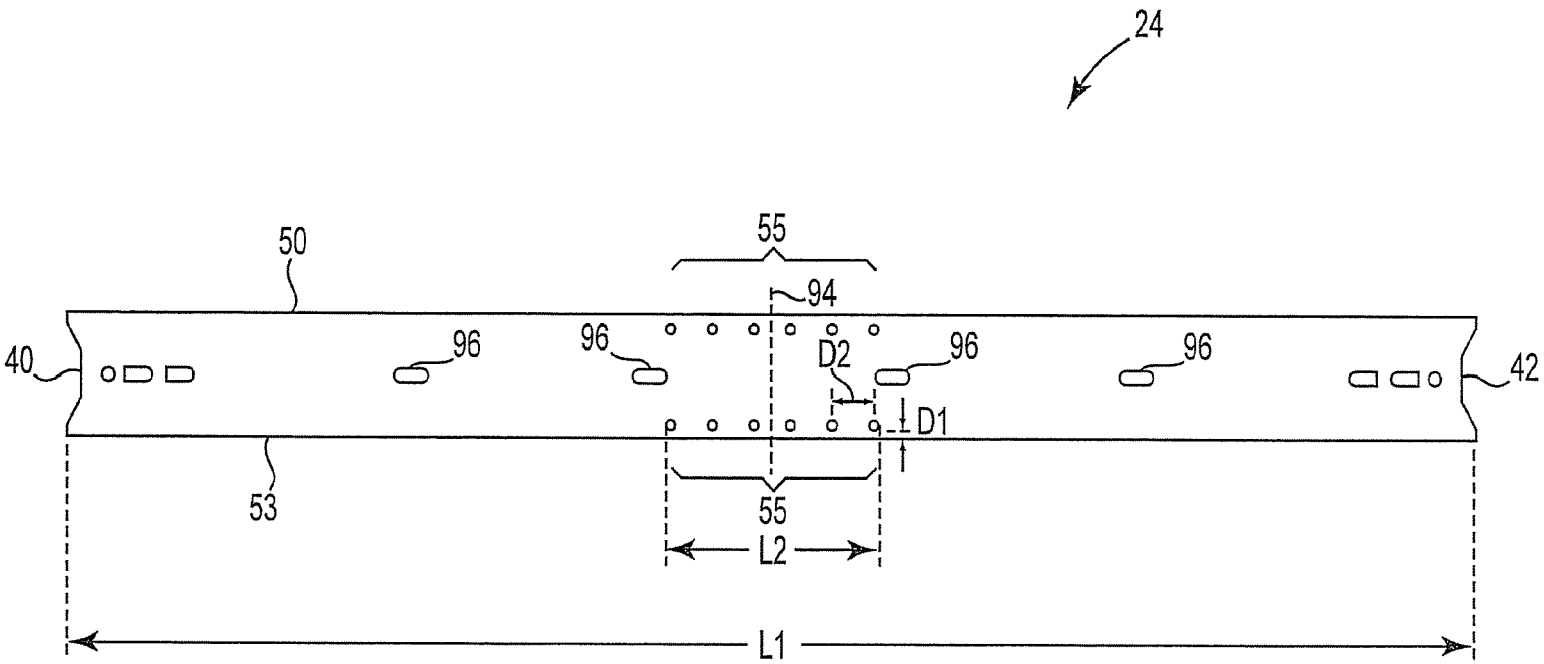
FIG. 11 is a diagram illustrating a rear blade of the squeegee assembly of FIG. 3 detached therefrom and positioned such that the blade is substantially flat.

FIG. 11 is a diagram illustrating rear blade 24 detached from squeegee assembly 20 and positioned such that the blade is substantially flat. As shown in FIG. 11, rear blade 24 includes a total of six apertures 55 spaced along the length of the blade. However, as will be appreciated by those skilled in the art, embodiments of a rear blade in accordance with the present invention having any number of apertures, including a single aperture, are possible. Thus, rear blades having one or more apertures are within the intended scope of the present invention. Additionally, apertures 55 are spaced along rear blade 24 such that there are three apertures to the left of center 94 of rear blade 24, which may substantially coincide with the center 44 of suction tube 28, and three apertures to the right of center 94 of rear blade 24 mirroring the position of the apertures on the left.

The bottom portion of each aperture 55 in rear blade 24 is positioned at a distance D1 from lower surface 53. Furthermore, each aperture 55 is spaced apart from the next closest aperture 55 by a distance D2. In one exemplary embodiment, distance D1 is equal to about one-half of the thickness of rear blade 24, or about 0.125 inches with a blade thickness of about 0.25 inches in the embodiment previously described. However, numerous other values of distance D1 are also contemplated. Furthermore, distance D1 may have a relationship with rear blade 24 other than one-half of the thickness of the blade without departing from the intended scope of the present invention. Additionally, the distance D1 between each aperture 55 and lower surface 53 does not have to be equal. For example, the distances D1 may instead vary, resulting in a plurality of apertures 55 configured in a "wavy" or "zigzag" pattern. Furthermore, with regard to the distance D2 between adjacent apertures 55, this distance may be a constant as illustrated in FIG. 11. Alternatively, distance D2 between adjacent apertures 55 may vary along the length of rear blade 24.

The length of rear blade 24 extending between first end 40 and second end 42 is shown in FIG. 11 as L1. Furthermore, apertures 55 are spaced along rear blade 24 such that the length between the beginning of the first aperture and the end of the last aperture is L2. In one exemplary embodiment, the length L1 of rear blade 24 may be about 30 inches, and the length from the beginning of the first aperture 55 to the end of the last aperture 55 may be about 5 inches. Thus, with respect to rear blade 24, the ratio L2:L1 may be about 1:6, or about 17%. Thus, about 17% of the length L1 of rear blade 24 includes apertures 55. Those skilled in the art will appreciate that the foregoing percentage may vary without departing from the intended scope of the present invention. For example, in a second exemplary embodiment the length L1 may be about 30 inches and the apertures 55 may be concentrated near the suction tube 28 of the squeegee assembly so that the length L2 is about 7 inches. In this second exemplary embodiment, approximately half of the apertures 55 may be on one side of the center 44 of suction tube 28 and approximately half of the apertures 55 may be on the opposing side.

Rear blade 24 may also contain a plurality of openings 96 structured to mate with a plurality of corresponding protrusions or flanges on support 26. The interaction between openings 96 and the protrusions or flanges on support 26, along with clamping band 66, may help to secure rear blade 24 to the support. However, these openings 96 are not necessary, and may be removed in alternative embodiments that utilize other "blade securing" means. Thus, openings 96 are not structured as vent or air holes that allow air from outside squeegee assembly 20 to be suctioned into the chamber formed between squeegee assembly 20 and the surface being cleaned in order to minimize or prevent the build-up of liquid adjacent an inner surface of rear blade 24.

Although not specifically discussed, if present, the "second set" of apertures 55 adjacent upper surface 50 of rear blade 24 may mirror the positions of the "first set" of apertures 55 adjacent lower surface 53 as described herein.

Figure 12:
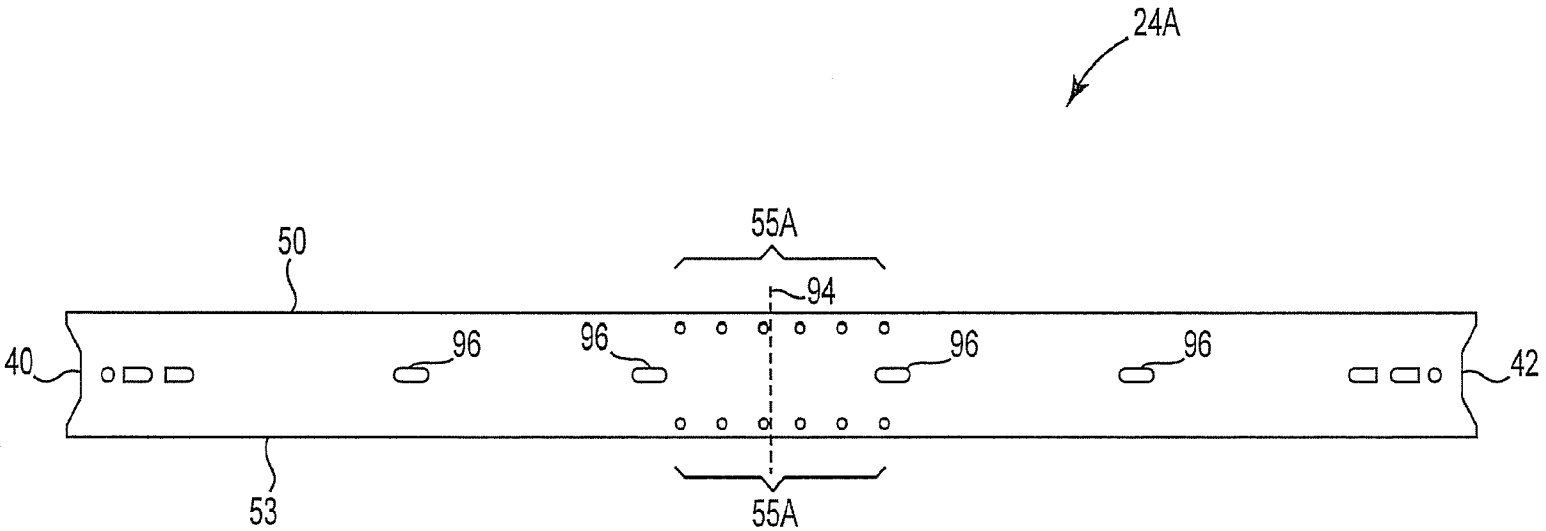
FIG. 12 is a diagram illustrating one exemplary alternative rear blade in accordance with the present invention.

FIG. 12 is a diagram illustrating rear blade 24A, which is one exemplary and alternative embodiment of rear blade 24 previously described. Rear blade 24A is substantially similar to rear blade 24 and also includes six apertures 55A spaced along the length of the blade. However, as shown in FIG. 12, the three apertures 55A to the left of center 94 of rear blade 24A do not mirror the positions of the three corresponding apertures 55A to the right of center 94 of blade 24A. Thus, the apertures 55A in rear blade 24A have an "offset" configuration. For example, the two "middle" apertures 55A are not equally spaced from center 94 of rear blade 24A. As will be appreciated by those skilled in the art, forming apertures 55A in such an offset manner may help achieve desired flow characteristics within squeegee assembly 20. For example, using offset apertures may help with the formation of a single vortex near lower end 46 of suction tube 28 as is illustrated in FIG. 13.

Figure 13:
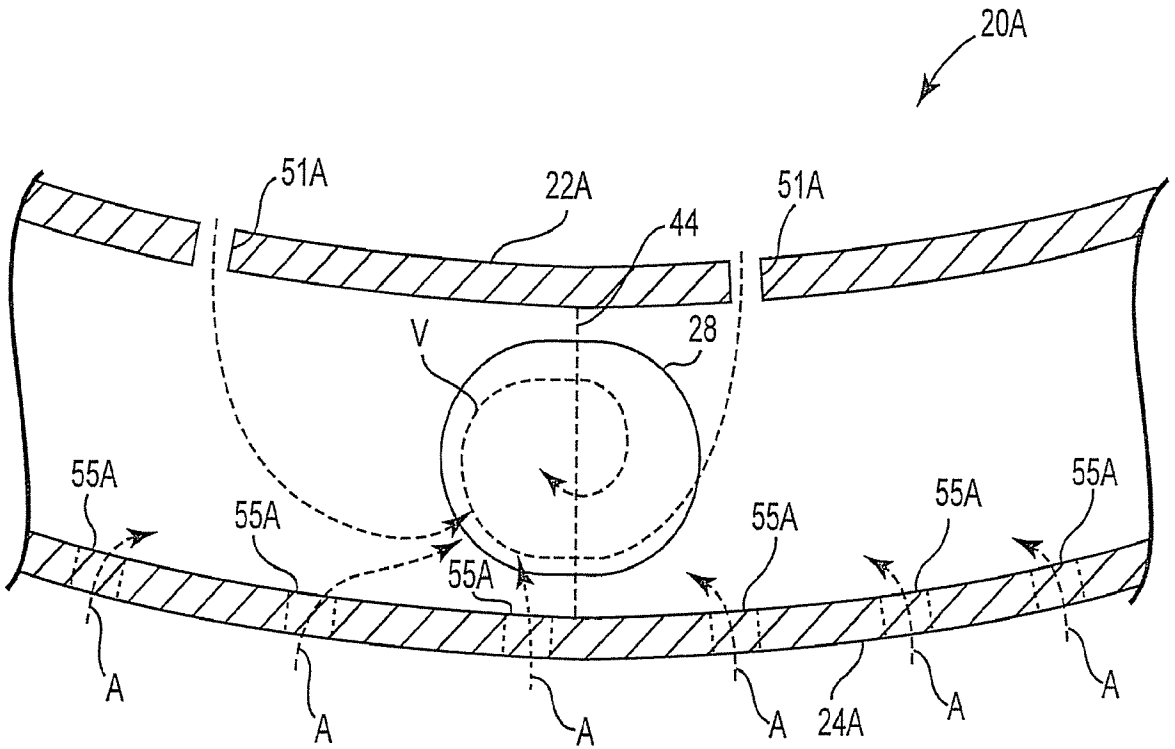
FIG. 13 is a diagram illustrating the exemplary airflow within a squeegee assembly utilizing the alternative rear blade of FIG. 12.

FIG. 13 is an exemplary diagram illustrating the airflow within a squeegee assembly 20A similar to squeegee assembly 20, but that instead includes rear blade 24A having "offset" apertures 55A. Additionally, squeegee assembly 20A includes a front blade 22A having slots 51A that are also "offset" as compared to the slots 51 previously described with reference to FIG. 5.

When slots 51A are offset relative to center 44 of suction tube 28 as illustrated, a single vortex V may be formed within suction tube 28. Having a single vortex V rather than a pair of vortexes within suction tube 28 may be preferable in some squeegee assembly configurations. Whether a single vortex is preferable may depend on numerous factors such as, for example, the cross-sectional shape of suction tube 28. Providing offset apertures 55A in rear blade 24A may help to maintain the single vortex V as will be appreciated by those skilled in the art.

As will be appreciated by those skilled in the art, round suction ports would benefit from a single vortex which may be achieved with offset apertures as discussed above. Suction ports with a length to width ratio in the range of about 2:1 would benefit from two distinct vortices which may be achieved with centered apertures as also discussed above.

Both of the exemplary rear blade embodiments disclosed thus far (i.e., rear blades 24 and 24A) have been illustrated as including apertures that are generally circular in shape. In one exemplary embodiment, the diameter of the aperture may be between about 0.13 and about 0.25 inches, although any suitable diameter is contemplated. Furthermore, although generally circular apertures are disclosed, any suitably shaped aperture may alternatively be used in place of, or in combination with, generally circular apertures without departing from the intended scope of the present invention. For example, alternative embodiments of rear blades may include apertures in the form of ovals, squares, rectangles, triangles, elongated slots, and the like. In addition to the shape of the apertures, the cross-sectional dimensions of the apertures may also vary as illustrated in FIGS. 14A-14G in order to provide, for example, reduced turbulence or increased speed of the incoming airflow.

In particular, FIGS. 14A-14G illustrate exemplary, but non-limiting aperture designs in accordance with the present invention. The various apertures are shown with an axis perpendicular to the inner and outer surface of the blade, but alternatively could be angled toward or away from the suction port, or directed upward or downward, or at any suitable angle relative to the inner and outer surface of the blade. As will be appreciated by those skilled in the art, perpendicular apertures are more conducive to die cutting or punching of blade materials.

Figure 14A:
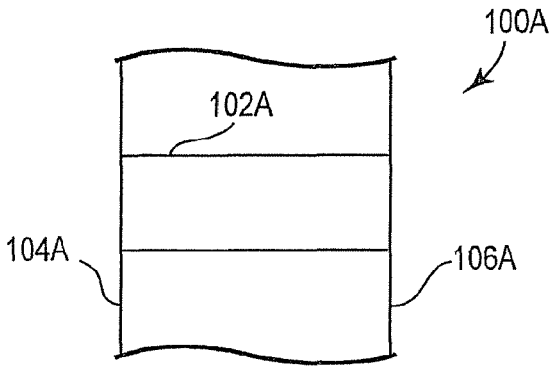
FIGS. 14A-14G illustrate exemplary, but non-limiting aperture designs for a rear blade in accordance with the present invention.
Figure 14B:
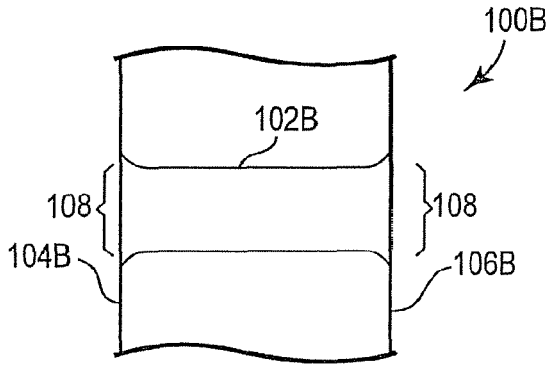
Figure 14C:
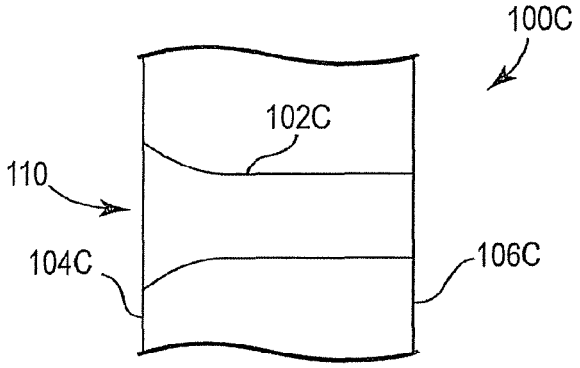
Figure 14D:
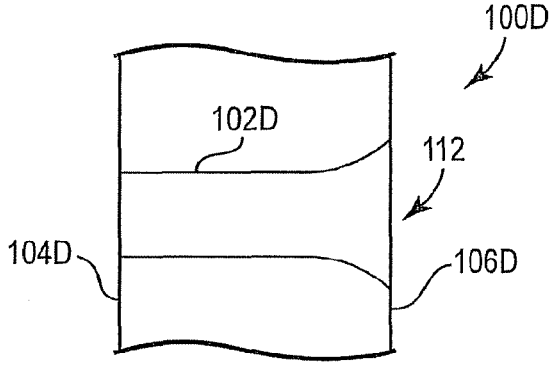
Figure 14E:
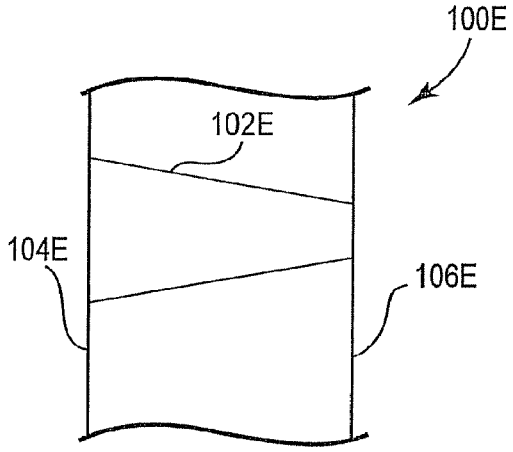
Figure 14F:
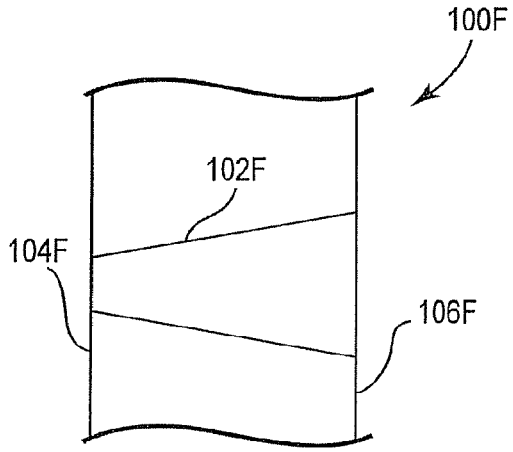
Figure 14G:
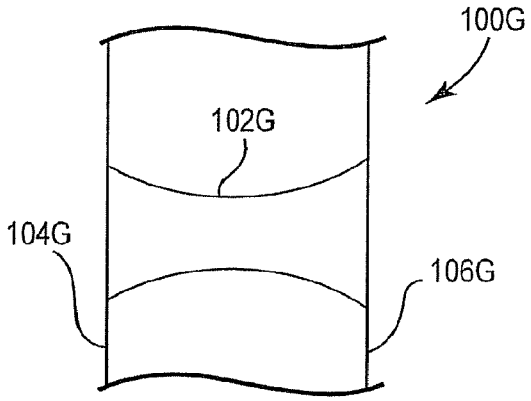

Beginning with FIG. 14A, a rear blade 100A is shown having an aperture 102A of constant diameter between an outer surface 104A and an inner surface 106A. This embodiment is similar to the embodiment of rear blade 24 having apertures 55 previously described. Next, FIG. 14B is a diagram illustrating a rear blade 100B having an aperture 102B with radiused or beveled edges 108. FIG. 14C is a diagram illustrating a rear blade 100C having an aperture 102C with a flared entry 110 along outer surface 104C. Similarly, FIG. 14D is a diagram illustrating a rear blade 100D having an aperture 102D with a flared exit 112 along inner surface 106D. Moving on to FIG. 14E, a rear blade 100E is illustrated having a generally conical shaped aperture 102E with an opening along outer surface 104E that is larger than an opening along inner surface 106E. Next, FIG. 14F is a diagram illustrating a rear blade 100F also having a generally conical shaped aperture 102F with an opening along outer surface 104F that is smaller than an opening along inner surface 106F. Finally, FIG. 14G is a diagram illustrating a rear blade 100G having an aperture 102G with an interior surface that is curved between outer surface 104G and inner surface 106G of the blade. As will be appreciated by those skilled in the art, FIG. 14G represents a typical aperture cross-section that may result from die cutting or punching a circular aperture into a thin rear blade formed of rubber or the like. As will further be appreciated by those skilled in the art, numerous other aperture designs are also possible and within the intended scope of the present invention, including various combinations of the designs disclosed herein.

Figure 15:
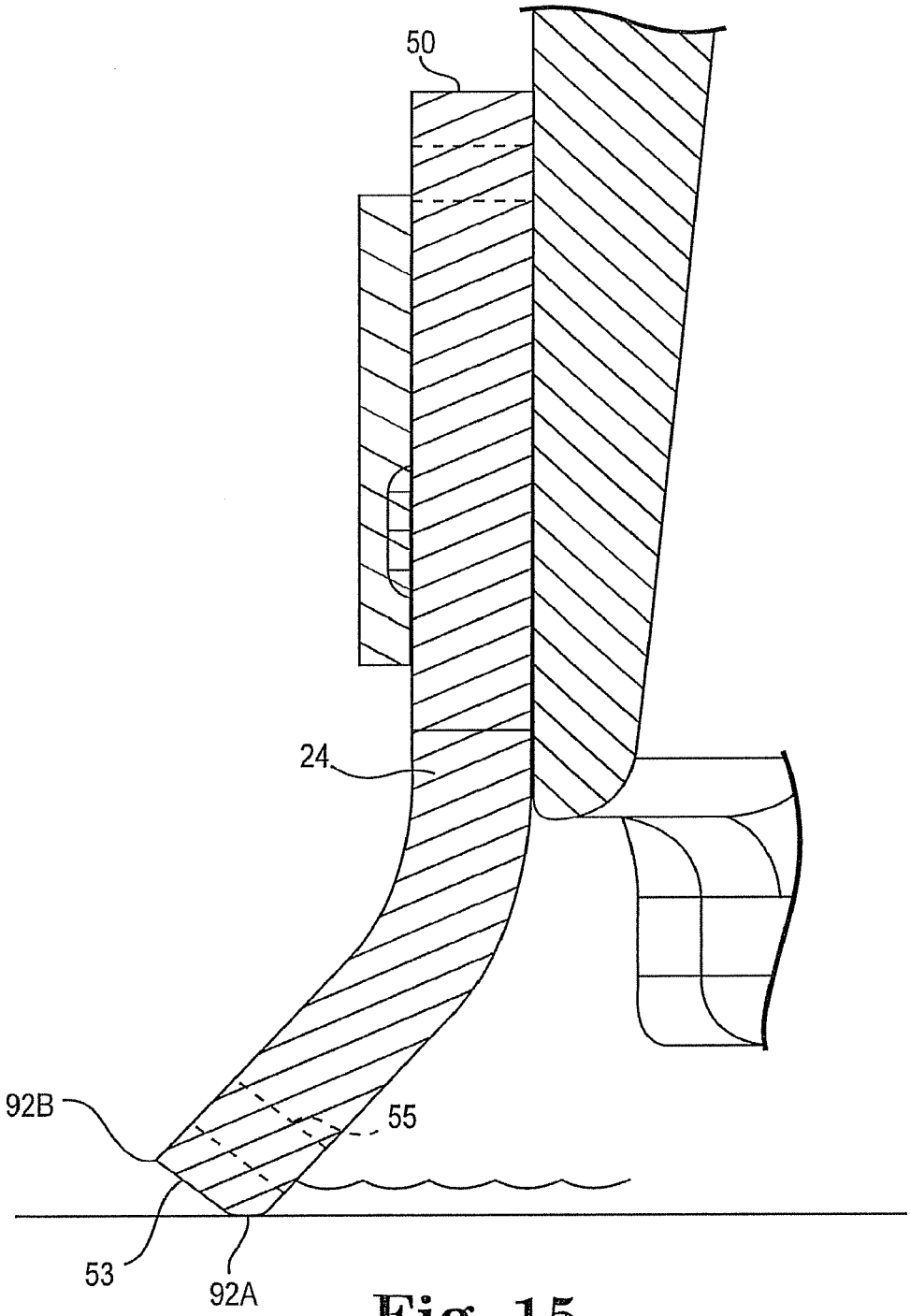
FIG. 15 is a diagram illustrating a second aspect of the present invention wherein apertures in a rear blade of a squeegee assembly may function as wear indicators.

Although providing apertures in a rear blade of a squeegee assembly is useful to prevent the pooling of liquid along the inner surface of the blade as previously discussed, the presence of such apertures may provide additional benefits unrelated to airflow. Particularly, in a second aspect of the present invention the apertures in the rear blade may function as wear indicators as illustrated in FIG. 15. In particular, FIG. 15 is a diagram illustrating a portion of rear blade 24 in the operational mode previously depicted with reference to FIG. 9. As illustrated in FIG. 15, rear blade 24 is arranged such that first wiping edge 92A is the edge that wipes the floor surface during the cleaning procedure. However, over an extended period of use, first wiping edge 92A will begin to wear down, resulting in a curved or flattened edge that recedes toward second wiping edge 92B.

In the second aspect of the present invention, apertures 55 may function as wear indicators that inform an operator when it is time to reverse rear blade 24 so that a new wiping edge is implemented. The wear indicator may function in one of two ways. First, the operator may occasionally perform a visual inspection of rear blade 24 in order to monitor the wear on the edge. When the "worn" area of the wiping edge approaches the end of aperture 55, it is time to reverse rear blade 24. Second, the operator may wait until the squeegee assembly begins leaving streaks behind rear blade 24 during the cleaning procedure. Particularly, when the curved/flattened portion of the wiping edge reaches aperture 55, gaps may form between the wiping edge and the surface being cleaned. As a result, liquid may escape beneath rear blade 24, leaving streaks or small puddles of liquid behind.

As previously mentioned with reference to FIG. 11, one exemplary distance D1 between lower surface 53 of rear blade 24 and apertures 55 is equal to about one-half of the thickness of rear blade 24. Generally speaking, it has been found that at the point where the worn portion of the wiping edge reaches the apertures, this worn portion spans approximately one-half of the thickness of the rear blade. Thus, when used as wear indicators, it may be preferable to space the apertures from the adjacent lower surface of the blade by a distance equal to about one-half of the thickness of the blade. However, those skilled in the art will appreciate that this exemplary spacing is not a necessary component of the present invention, and any suitable spacing may be used.

Although the present invention has been described with reference to preferred embodiments, workers skilled in the art will recognize that changes may be made in form and detail without departing from the spirit and scope of the invention.

What is claimed is:

1. A squeegee assembly for wiping a surface to be cleaned comprising:

a front flexible blade having an outer surface, an inner surface, and a floor engaging edge, the front flexible blade including at least one slot formed in the floor engaging edge structured for the passage of fluid therethrough, the front flexible blade defining a first blade configuration;

a rear flexible blade having outer surface open to an exterior of the squeegee assembly, an inner surface facing the front flexible blade, and a continuous wiping edge extending along a straight or curved line between a first end and a second end of the rear flexible blade, the rear flexible blade including at least one aperture extending from the outer surface to the inner surface, toward the front flexible blade and spaced from the wiping edge, the rear flexible blade defining a second blade configuration different than the first blade configuration;

a support upon which the front and rear flexible blades are mounted, wherein a suction chamber is formed between the front flexible blade, the rear flexible blade, and a bottom surface of the support; and a suction tube in fluid communication with the suction chamber, wherein the at least one aperture in the rear flexible blade is structured for providing an airflow path through the rear flexible blade and into the suction tube.

2. The squeegee assembly of claim 1, wherein the at least one aperture in the rear flexible blade is offset from a center of the suction tube.

3. The squeegee assembly of claim 2, wherein the at least one slot in the front flexible blade is offset from the center of the suction tube.

4. The squeegee assembly of claim 1, wherein the front flexible blade and the rear flexible blade each form an arc at least partially between a first end of the support and a second end of the support.

5. The squeegee assembly of claim 1, wherein the suction tube includes flow directing means adjacent a lower end of the suction tube.

6. The squeegee assembly of claim 1, wherein the at least one aperture passes through the rear flexible blade between the bottom surface of the support and the surface to be cleaned.

7. The squeegee assembly of claim 1, wherein the at least one aperture is spaced from the wiping edge by a distance approximately equal to one-half of a thickness of the rear flexible blade.

8. The squeegee assembly of claim 1, wherein the at least one aperture has a substantially circular cross-sectional shape.

9. The squeegee assembly of claim 8, wherein at least a portion of the at least one aperture has a diameter of about 0.19 inches.

10. The squeegee assembly of claim 1, wherein the at least one aperture has a flared inlet.

11. A squeegee assembly for wiping a surface comprising:

a front flexible blade including a first end, a second end, a lower edge, and at least one slot formed in the lower edge structured for the passage of fluid therethrough, the front flexible blade defining a first blade configuration;

a rear flexible blade including a first end, a second end an outer surface open to an exterior of the squeegee assembly, an inner surface facing the front flexible blade, a continuous and linear wiping edge for contacting the surface, and at least one aperture extending through the rear flexible blade from the outer surface to the inner surface toward the front flexible blade, and spaced from the wiping edge, the rear flexible blade defining a second blade configuration different than the first blade configuration;

a support upon which the front and rear flexible blades are mounted; and a suction tube provided in the support and positioned between the front and rear flexible blades;

wherein the at least one aperture in the rear flexible blade is structured for providing an airflow path through the rear flexible blade and into the suction tube.

12. The squeegee assembly of claim 11, wherein the at least one aperture has a substantially circular cross-sectional shape.

13. The squeegee assembly of claim 12, wherein a diameter of the at least one aperture is substantially constant between an outer surface and an inner surface of the rear flexible blade.

14. The squeegee assembly of claim 12, wherein a diameter of the at least one aperture varies between an outer surface and an inner surface of the rear flexible blade.

15. The squeegee assembly of claim 11, wherein the rear flexible blade includes a plurality of apertures spaced from the wiping edge.

16. A squeegee assembly for wiping a surface comprising:

a front blade including a first end, a second end, a lower edge, and first and second slots formed in the lower edge, the front blade defining a first blade configuration;

a rear blade including a first end, a second end, an outer surface open to an exterior of the squeegee assembly, an inner surface facing the front blade, a wiping edge for contacting the surface and at least one aperture extending through the rear blade from the outer surface to the inner surface toward the front blade, the wiping edge being continuous and extending along a straight or curved line between the first end and the second end of the rear flexible blade, the rear blade defining a second blade configuration different than the first blade configuration;

a support upon which the front and rear blades are mounted; and a suction tube provided in the support and positioned between the front and rear blades;

wherein the first slot in the lower edge of the front blade is spaced from a center of the suction tube by a first distance, and wherein the second slot in the lower edge of the front blade is spaced from the center of the suction tube by a second distance that is different than the first distance such that an offset slot configuration is formed in the front blade and wherein the at least one aperture in the rear blade is structured for providing an airflow path through the rear flexible blade and into the suction tube.

* * * * *

UNITED STATES PATENT AND TRADEMARK OFFICE

CERTIFICATE OF CORRECTION

PATENT NO. : 9,038,237 B2
APPLICATION NO. : 12/531660
DATED : May 26, 2015
INVENTOR(S) : David W. Wood It is certified that error appears in the above-identified patent and that said Letters Patent is hereby corrected as shown below:

In the Claims

In column 12, line 12, in Claim 1, after “having”, insert --an--, therefor

Signed and Sealed this
Fifth Day of January, 2016

Michelle K. Lee

Michelle K. Lee
*Director of the United States Patent and Trademark Office*